US011033456B1

(12) United States Patent
Schwartz

(10) Patent No.: US 11,033,456 B1
(45) Date of Patent: Jun. 15, 2021

(54) METHODS AND APPARATUS FOR POSITIONING ACUPRESSURE TOOLS ON A PATIENT FOR WEIGHT LOSS

(71) Applicant: Barbara Ellen Schwartz, New York, NY (US)

(72) Inventor: Barbara Ellen Schwartz, New York, NY (US)

( * ) Notice: Subject to any disclaimer, the term of this patent is extended or adjusted under 35 U.S.C. 154(b) by 60 days.

(21) Appl. No.: 16/101,073

(22) Filed: Aug. 10, 2018

(51) Int. Cl.
*A61H 39/08* (2006.01)
*A61H 39/02* (2006.01)

(52) U.S. Cl.
CPC ..... *A61H 39/086* (2013.01); *A61H 39/02* (2013.01); *A61H 2205/02* (2013.01)

(58) Field of Classification Search
CPC ... A61H 39/02; A61H 39/086; A61H 2205/02
See application file for complete search history.

(56) References Cited

U.S. PATENT DOCUMENTS 2,245,350 A * 6/1941 Marshall ..... A61M 5/427 33/511
4,798,195 A * 1/1989 Seare, Jr. ..... A61B 17/02 600/206
5,290,307 A * 3/1994 Choy ..... A61H 39/04 128/101.1
6,053,931 A * 4/2000 Lizcano ..... A44C 7/001 606/188
6,458,146 B1 10/2002 Kramer
7,309,236 B1 * 12/2007 Ward ..... G09B 19/0015 434/262
8,257,341 B1 * 9/2012 Fletcher ..... A61B 17/7071 604/512
10,342,304 B1 * 7/2019 Vasnin ..... A44C 7/001
2011/0313441 A1 * 12/2011 Song ..... A61H 39/08 606/189
2014/0039451 A1 * 2/2014 Bangera ..... B29C 64/393 604/506
2014/0039452 A1 * 2/2014 Bangera ..... A61M 5/46 604/506

OTHER PUBLICATIONS

"Accu-Point Chart," Accu Weight-Loss Systems, Inc., 2015, 1 page.

* cited by examiner

*Primary Examiner* — Richard G Louis
(74) *Attorney, Agent, or Firm* — Cooley LLP

(57) ABSTRACT

Apparatus and methods for positioning acupressure tools are disclosed herein. In one embodiment, an apparatus includes a template. A portion of the template is sized and shaped to be partially disposed about a curvature of a preselected portion of a body. The template defines a set of apertures. Each aperture from the set of apertures is configured to be disposed overlying a unique preselected acupoint of the body from a set of preselected acupoints of the body when the portion of the template is partially disposed about the curvature.

19 Claims, 5 Drawing Sheets

METHODS AND APPARATUS FOR POSITIONING ACUPRESSURE TOOLS ON A PATIENT FOR WEIGHT LOSS

BACKGROUND

The embodiments described herein relate generally to methods and apparatus for positioning acupressure tools, and more particularly, to methods and apparatus for positioning acupressure tools on a patient for weight loss.

Acupressure is a form of traditional Chinese medicine that involves applying pressure to acupressure points of a patient's body. The body has numerous acupressure points, and so the specific acupressure points targeted are determined based on the health benefit sought by the patient. One such health benefit for which acupressure is used is to promote weight loss. One known acupressure weight loss system includes applying acupressure to acupressure points located on the patient's head behind the ear, and particularly to a set of twelve acupressure points on the patient's head and behind the ear. Although the acupressure points on the head and behind the ear include multiple acupressure points, usually only one of the acupressure points is active (or ripe) at a time, while the other acupressure points are inactive (or dull). As such, the active acupressure point should be located and have acupressure applied thereto to promote the patient's weight loss goals. This has previously been accomplished using charts and estimations, resulting in a high potential for error in locating the active acupressure point if not performed by a trained acupressure practitioner or other person trained to locate and position an acupressure tool on the desired acupressure point. Also, such behind-the-ear acupressure points are closely spaced together, and in some cases may overlap to some extent. For at least these reasons, it is very difficult for a patient to properly locate the desired (e.g., active) acupressure point on himself or herself, or for an untrained user to properly locate the desired acupressure point on another person (e.g., the patient).

Thus, a need exists for apparatus and methods that help an acupressure practitioner to more easily locate a particular acupressure point from amongst closely located acupressure points. A need also exists for apparatus and methods that help a patient or other user (e.g., a patient or other user that is remote from an acupressure practitioner) to locate a particular acupressure point. A need further exists for apparatus and methods that help the acupressure practitioner, patient, or other user to position of an acupressure tool with respect to the desired acupressure point, and more particularly that assists with repeatable positioning of the acupressure tool with respect to a desired acupressure point from a set of acupressure points.

SUMMARY

The embodiments described herein relate to apparatus and methods for accurately positioning an acupressure tool with respect to a preselected acupressure point, and particularly with respect to a preselected acupressure point associated with promoting weight loss. In some embodiments, an apparatus includes a template. A portion of the template is sized and shaped to be partially disposed about a curvature of a preselected portion of a body. The template defines a set of apertures. Each aperture from the set of apertures is configured to be disposed overlying a unique preselected acupoint of the body from a set of preselected acupoints of the body when the portion of the template is partially disposed about the curvature.

DETAILED DESCRIPTION

Figure 1:
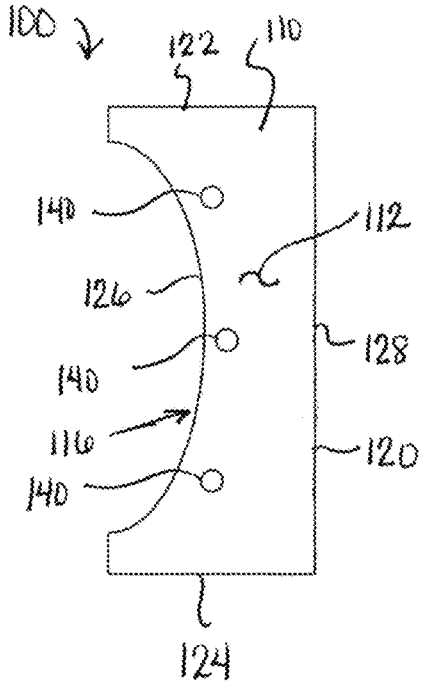
FIG. 1 is a schematic view of an acupoint locator apparatus, according to an embodiment.

Apparatus and methods for positioning acupressure tools are disclosed herein. More particularly, embodiments described herein relate to apparatus and methods for accurately positioning an acupressure tool with respect to a preselected acupressure point (also referred to herein as "acupoints") of a body of a patient. In some embodiments, an apparatus includes a template. A portion of the template is sized and shaped to be partially disposed about a curvature of a preselected portion of the body. The template defines a set of apertures. Each aperture from the set of apertures is configured to be disposed overlying a unique preselected acupoint of the body from a set of preselected acupoints of the body when the portion of the template is partially disposed about the curvature.

The set of apertures can include a first aperture that is configured to be located on a transverse plane of the body taken at a midline of an ear when the portion of the template is partially disposed about the curvature. Each aperture of the set of apertures can be configured to be disposed, overlying a unique preselected acupoint of the body from the set of preselected acupoints that are associated with weight loss. At least a subset of the set of apertures can form a curvilinear pattern. The set of apertures can include a first aperture having a diameter within a range of about 0.5 mm to about 10 mm. Each aperture from the set of apertures can be sized to permit at least one of an acupressure bead to be passed therethrough or a marking instrument to be at least partially passed therethrough, without permanent deformation of the template at a perimeter of that aperture. Alternatively, the template can include a marker that is at least partially transferable to a skin of the body. In some embodiments, the template has a first surface and a second surface opposite the first surface. The first surface can include an indicia configured to be aligned, along a transverse plane of the body, with one of a midline of an ear, a top of an attachment of the ear to a head, or a bottom of the attachment of the ear to the head.

In some embodiments, a method includes disposing a template on a surface of a body relative to a preselected anatomical structure of the body such that a first portion of a perimeter of the template is positioned at least partially around at least a portion of the preselected anatomical structure and such that an acupoint locator of the template is positioned overlying a preselected acupoint of the body, and placing, after the disposing, an acupressure tool on the preselected acupoint. The acupressure tool can be at least one of, separate from or separable from the template. The acupressure tool can include an acupressure bead. The method can include marking the preselected acupoint via a transferable marker disposed on the template at the acupoint locator or via a marking instrument disposed through an aperture defined by the template at the acupoint locator. The method can include aligning, when the first portion of the perimeter of the template is positioned at least partially around the portion of the preselected anatomical structure, at least one of a tactile indicium or a visual indicium of the template with a transverse plane of the body. The transverse plane of the body can be taken at one of a midline of the preselected anatomical structure or a preselected attachment location of the preselected anatomical structure to another portion of the body. The acupoint locator can be intersected by the transverse plane. The method can also include disposing a channel defined by the template over an upper outer surface of an ear. The acupoint locator can include an aperture. The acupressure tool can be an acupressure bead. The method can include coupling the acupressure bead to the body at the preselected acupoint. In some embodiments, the acupressure bead is passed through the aperture before the coupling and/or at least partially disposed within the aperture before the coupling.

In some embodiments, an apparatus includes a template configured to locate a set of acupoints in reference to a preselected anatomical structure when the template is disposed relative to the preselected anatomical structure. The template has a perimeter. The perimeter includes a first end portion, a second end portion opposite the first end portion, a first side portion extended between the first end portion and the second end portion, and a second side portion extended between the first end portion and the second end portion. The second side portion is opposite the first side portion. The first side portion is concave. The second side portion is convex. The template defines a set of acupoint locators. The set of acupoint locators is configured to be positioned overlying the set of acupoints when at least a portion of the preselected anatomical structure is received in the concave first side portion of the perimeter of the template. The set of acupoint locators can include a first subset of acupoint locators arranged in a curvilinear pattern that is concave with respect to the first side portion and a second subset of acupoint locators arranged offset from the curvilinear pattern.

The template can include a preformed hook portion. The preformed hook portion and the first end portion can collectively define a channel that receives at least a portion of the anatomical structure when the at least the portion of the preselected anatomical structure is received in the concave first side portion of the perimeter of the template such that the template is retained to the anatomical structure. A first surface of the hook portion can be co-planar with a first surface of the template extended between the first side portion and the second side portion. The second side portion of the template can include a grip portion extended therefrom. The grip portion can be sized and configured to be grasped by a user when the portion of the preselected anatomical structure is received in the concave first side portion of the perimeter of the template and the set of locators is positioned overlying the set of acupoints.

In some embodiments, the template can be a first template, the set of acupoints is a first set of acupoints, and the set of acupoint locators is a first set of acupoint locators, and the apparatus can also include a second template configured to locate a second set of acupoints in reference to the preselected anatomical structure when the template is disposed relative to the preselected anatomical structure. The second set of acupoints can be different from the first set of acupoints. The second template can have a perimeter that includes a first end portion, a second end portion opposite the first end portion, a first side portion extended between the first end portion and the second end portion, and a second side portion extended between the first end portion and the second end portion. The second side portion of the second template can be opposite the first side portion of the second template. The first side portion of the second template can be concave and the second side portion of the second template can be convex. The second template can define a second set of acupoint locators that can include at least one acupoint locator positioned with respect to template differently from each acupoint locator of the first set of acupoint locators. The second set of acupoint locators can be configured to be positioned overlying the second set of acupoints when at least a portion of the preselected anatomical structure is received in the concave first side portion of the perimeter of the second template.

As used in this specification and the appended claims, the singular forms "a," "an" and "the" include plural referents unless the context clearly dictates otherwise. Thus, for example, the term "a member" is intended to mean a single member or a combination of members, "a material" is intended to mean one or more materials, or a combination thereof.

As used herein, and unless the context clearly indicates otherwise, the words "proximal" and "distal" refer to the direction closer to and away from, respectively, a user (e.g., a patient or other person to whom acupressure is or will be applied).

As used herein, the terms "reversible," "reversibly," and/or the like when used to described a process and/or procedure generally refer to a non-destructive process or procedure that can be subsequently undone by a similar yet substantially opposed, inverse, and/or opposite non-destructive process or procedure. When used herein with respect to attachment and/or detachment of an element or assembly, a reversible attachment refers to a non-destructive, repeatable attachment and/or detachment of the element or assembly.

As used herein, the terms "about" and/or "approximately" when used in conjunction with numerical values and/or ranges generally refer to those numerical values and/or ranges near to a recited numerical value and/or range. For example, in some instances, "about 40 [units]" can mean within ±25% of 40 (e.g., from 30 to 50). In some instances, the terms "about" and "approximately" can mean within ±10% of the recited value. In other instances, the terms "about" and "approximately" can mean within ±9%, ±8%, ±7%, ±6%, ±5%, ±4%, ±3%, ±2%, ±1%, less than ±1%, or any other value or range of values therein or therebelow. The terms "about" and "approximately" may be used interchangeably. Furthermore, although a numerical value modified by the term "about" or "approximately" can allow for and/or otherwise encompass a tolerance of the stated numerical value, it is not intended to exclude the exact numerical value stated.

In a similar manner, term "substantially" when used in connection with, for example, a geometric relationship, a numerical value, and/or a range is intended to convey that the geometric relationship (or the structures described thereby), the number, and/or the range so defined is nominally the recited geometric relationship, number, and/or range. For example, two structures described herein as being "substantially parallel" is intended to convey that, although a parallel geometric relationship is desirable, some non-parallelism can occur in a "substantially parallel" arrangement. By way of another example, a structure defining a diameter that is "substantially 100 millimeters (mm)" is intended to convey that, while the recited diameter is desirable, some tolerances can occur when the volume is "substantially" the recited volume (e.g., 100 mm). Such tolerances can result from manufacturing tolerances, measurement tolerances, and/or other practical considerations (such as, for example, minute imperfections, age of a structure so defined, a pressure or a force exerted within a system, and/or the like). As described above, a suitable tolerance can be, for example, of ±1%, ±2%, ±3%, ±4%, ±5%, ±6%, ±7%, ±8%, ±9%, ±10%, or more of the stated geometric construction, numerical value, and/or range. Furthermore, although a numerical value modified by the term "substantially" can allow for and/or otherwise encompass a tolerance of the stated numerical value, it is not intended to exclude the exact numerical value stated.

While numerical ranges may be provided for certain quantities, it is to be understood that these ranges can include all subranges therein. Thus, the range "from 50 to 80" includes all possible ranges therein (e.g., 51-79, 52-78, 53-77, 54-76, 55-75, . . . , 70-79, etc.). Furthermore, all values within a given range may be an endpoint for the range encompassed thereby (e.g., the range 50-80 includes the ranges with endpoints such as 55-80, 50-75, etc.).

FIG. 1 is a schematic illustration of an apparatus 100 according to an embodiment. The apparatus is configured to help a user properly position an acupressure tool with respect to a preselected acupoint of the body of the patient. The user can be the patient, or a person other than the patient. The acupressure tool can be any suitable tool for applying acupressure to a patient including, but not limited to, an acupressure bead, a bandage, a stimulator or reflex pen (e.g., an electronic stimulator pen), or other acupressure, massage or reflexology tool or device. In some embodiments, the acupressure tool can include a portion of a body (e.g., finger, palm, hand, elbow, foot or the like). In some embodiments, the acupressure tool can include a marking instrument (e.g., a surgical pen or marker or the like, a pre-inked button, a temporary tattoo, or the like), used to apply a marking to the body to indicate an acupoint location for subsequent application of acupressure thereto.

The apparatus 100 includes a template 110, which is sized and shaped to be disposed on a surface of the body relative to a preselected anatomical structure. More specifically, the template 110 can be sized and shaped to be disposed on the body surface relative to the preselected anatomical structure such that at least one acupoint locator 140 of the template 110 is positioned overlying a preselected acupoint of the body. The acupoint locator 140 can be used to properly position the acupressure tool with respect to the one of multiple preselected acupoints (e.g., the preselected acupoint over which the acupoint locator 140 is disposed or a different unique preselected acupoint), as described herein.

The template 110 can include a first (e.g., top) surface 112 and a second (e.g., bottom) surface opposite the first surface (not shown in FIG. 1). In some embodiments, at least one of the first surface 112 or second surface is substantially planar (e.g., in the absence of a deformation force). In some embodiments, the template 110 is flexible or bendable. In this manner, template 110 can be flexed or bent (e.g., by a user or a patient) to at least partially conform to a surface of the body such that the first surface 112 or the second surface is disposed in contact with a surface of the body. The template 110 can be constructed of any suitable material. For example, the template 110 can be constructed of a plastic, rubber, silicone, metal, paper, cloth, wood, or the like, or any suitable combination thereof.

The template 110 has a perimeter 120. The perimeter 120 of the template 110 can include or otherwise be formed by side portions (not shown in FIG. 1) of the template 110 that extend from the first surface 112 to the second surface. The perimeter 120 can include a first end portion 122 and a second end portion 124 opposite the first end portion. The perimeter 120 can include a first side portion 126 that is extended between the first end portion 122 and the second end portion 124, and a second side portion 128 that is extended between the first end portion 122 and the second end portion 124. The second side portion 128 is opposite, with respect to at least one of the first surface 112 or the second surface of the template 110, from the first side portion 126.

A portion of the template 110 is sized and shaped to be partially disposed about a curvature of a preselected portion or anatomical structure of a body (not shown in FIG. 1). In some embodiments, the preselected portion of the body (or preselected anatomical structure) is an ear or a head of the patient. More specifically, in some embodiments, the template 110 is sized and shaped to be partially disposed about a curvature of the body at a location where the ear attaches to the head of the patient (e.g., at an attachment location behind the ear). For example, referring to FIG. 1, the template 110 includes a curved portion 116 that is sized and shaped to be at least partially disposed about the preselected portion of bodily curvature. The curved portion 116 of the template 110 can be substantially concave or recessed with respect to the perimeter 120 of the template 110. Said another way, the first side portion 126 of the perimeter 120 can be concave, curved, or otherwise recessed (e.g., from a top or bottom view of the template). In some embodiments, the first side portion 126 includes the curved portion 116, such that the first side portion 126 is shaped and sized to be disposed at least partially around the preselected anatomical structure (e.g., a curvature of the body behind the ear and at a location where the ear is attached to the head).

The second side portion 128 can have any suitable shape and size. In some embodiments, the second side portion 128 can be convex. At least a portion of the second side portion 128 can have a convex curvature that is substantially parallel to a concave curvature of the first side portion 126. The convex second side portion 128 can enable a user to grasp the template 110 during use. In some embodiments, the second side portion 128 can include a grip portion (not shown in FIG. 1) configured to be grasped by the fingers or hand of the user when disposing the template 110 with respect to the preselected anatomical structure. The grip portion can be, for example, a tab-like portion that extends from the second side portion 128. The grip portion can have any suitable shape. In some embodiments, the grip portion can be monolithically formed with the template. In some embodiments, the grip portion is separately constructed and coupled to the template.

In some embodiments, the template 110 includes an indicia (not shown in FIG. 1) for indicating an alignment of the template. For example, the template 110 can include a visual and/or tactile indication that is configured to be aligned with a preselected anatomical location when the template is disposed on the surface of the body relative to the preselected anatomical structure. The indicia can, for example, be configured to be aligned, along a transverse plane of the body, with a midline of an ear, a top of an attachment of the ear to a head, and/or a bottom of the attachment of the ear to the head, thereby indicating proper positioning of the template with respect to the body (and the preselected anatomical structure).

The acupoint locator 140 of the apparatus 100 enables a user to locate and thereby properly position an acupressure tool with respect to a unique preselected acupoint, when the template 110 is aligned with the preselected anatomical structure as described herein. The acupoint locator 140 is disposed with respect to the template 110 such that, when the template 110 is properly disposed on or with respect to the surface of the body relative to the preselected anatomical structure, as described herein, the acupoint locator 140 is positioned overlying a preselected acupoint of the body. For example, the template 110 can be positioned behind the ear and about a curvature of the ear (or a location of attachment of the ear to the head), such that one of the first surface 112 or second surface of the template 110 is disposed on or overlying the head and such that the acupoint locator 140 is positioned overlying a preselected acupoint of the head. In some embodiments, the preselected acupoint is located between the attachment of the rear of the ear to the head and the patient's natural hairline above and/or behind the ear.

The acupoint locators 140 (e.g., the apertures) can be arranged with respect to the template 110 in any suitable pattern that results in the acupoint locators 140 being disposed overlying the preselected acupoints when the template 110 is properly positioned with respect to the preselected anatomical structure, as described herein. For example, in some embodiments, each acupoint locator 140 is spaced inwardly from the perimeter 120 of the template 110 by a predetermined distance, though the distance between the perimeter 120 and any one acupoint locator 140 can be different from the distance between the perimeter 120 and any other acupoint locator 140.

The template 110 can include any suitable number of acupoint locators 140. For example, the template 110 can include one, two, three, four, five, six, seven, eight, nine, ten, eleven, or twelve, or more acupoint locators 140. In some embodiments, the acupoint locator 140 is or includes an aperture defined by the template. The aperture 140 can be an opening that extends from the first surface 112 of the template 110 to the second surface of the template. The template 110 can include any suitable number of apertures 140, including, but not limited to, one to twenty apertures. In some embodiments, the template 110 includes three apertures (as shown in FIG. 1). In some embodiments, the template 110 includes twelve apertures (see, e.g., FIG. 2), each associated with a location of one of twelve preselected acupoints of the head that are selectively used to promote weight loss. In some embodiments, the template 110 includes multiple apertures, at least one of which is configured to be positioned overlying two preselected acupoints. For example, the template 110 can include an aperture 140 that has a first end portion that can be positioned overlying a first preselected acupoint and a second end portion that can be positioned overlying a second preselected acupoint. In such an embodiment, the aperture 140 can be, for example, an elongate opening. In this manner, manufacturing costs can be reduced by reducing the total number of apertures produced during production of the template 110, without necessarily reducing the total number of preselected acupoints that can be located using the template 110.

For example, as shown in FIG. 1, the acupoint locators 140 can be arranged in a substantially curvilinear pattern (e.g., at least one location of each acupoint locator 140 intersects with or is within a predetermined distance (such as within about 0.5 cm, about 1 cm, about 1.5 cm or about 2 cm) from a respective point or location along a curved line, such as an arc or semicircular, C-shaped or U-shaped line). In some embodiments, the template includes a first subset of acupoint locators 140 (e.g., one, two or more acupoint locators, such as apertures) that are arranged in the substantially curvilinear pattern, and a second subset of acupoint locators 140 (e.g., one, two or more acupoint locators, such as apertures) that are arranged offset from the substantially curvilinear pattern (e.g., such that no location of the acupoint locator 140, or no portion of the opening of the aperture or the template defining the opening of the aperture, intersects with or is within the predetermined distance from the curved line). In some embodiments, the template 110 can include multiple acupoint locators 140 and at least two or more, or all, of the acupoint locators 140 are spaced apart from the first side portion 126 by a predetermined distance. Said another way, at least two of the acupoint locators 140 can be spaced apart from the first side portion 126, or more particularly the curved portion 116 of the template, by substantially the same distance.

The acupoint locator 140 can be any suitable size. For example, when the acupoint locator 140 is or includes an aperture, the aperture can be any suitable size that permits an acupressure bead or marking instrument to be at least partially passed therethrough or disposed therein, without permanent deformation of the template at a perimeter of that aperture. In this manner, the acupressure bead can be applied to or otherwise disposed on the preselected acupoint based on the location of (and optionally, through the aperture of) the acupoint locator 140. Also in this manner, a user can at least partially dispose a marking instrument through the aperture 140 to mark the location of the preselected acupoint so that the location of the preselected acupoint can be readily identified upon removal of the template 110 from the patient's body. The aperture 140 can have any suitable dimensions. For example, the aperture 140 can have a diameter within a range of about 0.5 mm to about 10 mm.

In some embodiments, the aperture 140 can have a diameter within a range of about 1 mm to about 4 mm. In some embodiments, the aperture 140 can have a diameter of about 2 mm.

In some embodiments, the acupoint locator 140 is or includes a transferable marker. The transferable marker can have a size similar to that described above with respect to the apertures. In some embodiments, the acupoint locator 140 includes both a transferable marker and an aperture. For example, the transferable marker can be disposed about at least a perimeter of the template defining the aperture. In another example, the transferable marker can be at least partially disposed within the aperture.

In some embodiments, the template 110 is configured to be removably coupled to the body of the patient. The apparatus 100 can include a coupling mechanism (not shown in FIG. 1) configured to removably couple the template 110 to the body. For example, the apparatus 100 can include a hook or the like configured to be disposed over a portion of the body such that the template 110 is retained thereon. More specifically, in some embodiments, the template 110 can include a hook portion configured to be disposed over a top of the attachment of the patient's ear to the patient's head such that a portion of the body (e.g., the ear-to-head attachment) is received in a channel defined by the hook portion. The hook portion can be monolithically formed with the template 110. In another example, the apparatus 100 can include a clip or clasp, such as a spring-loaded or other pressure-loaded clip or clasp, which can be configured to be coupled to the ear (or other body portion) of the patient. In still another example, the apparatus 100 can include an adhesive configured to removably adhere the template to the body. In some embodiments, the coupling mechanism is removable from the apparatus.

An apparatus 200 according to an embodiment is shown in FIGS. 2-5. The apparatus 200 is configured to help a user properly position an acupressure tool with respect to a preselected acupoint of the body of a patient. The user can be the patient, or a person other than the patient. The acupressure tool can be any suitable tool including, but not limited to, an acupressure bead, a marking instrument (e.g., a surgical marker or the like, a pre-inked button, temporary tattoo), a bandage, a stimulator or reflex pen (e.g., an electronic stimulator pen), or other, acupressure, massage or reflexology tool or device. In some embodiments, the acupressure tool can include a portion of a body (e.g., finger, palm, hand, elbow, foot or the like). The apparatus 200 can include one or more features that are similar, or identical, in many respects to the apparatus 100, or any other apparatus described herein, and can be constructed of one or more materials such as that described with respect to apparatus 100, or any other apparatus described herein.

The apparatus 200 includes a template 210. The template 210 is sized and shaped to be disposed on a surface of the body relative to a preselected anatomical structure. The template 210 can be sized and shaped to be disposed on the body surface relative to the preselected anatomical structure such that at least one acupoint locator 240 of the template 210 is positioned overlying a preselected acupoint of the body, as described herein.

The template 210 has a first (e.g., top or front) surface 212 and a second (e.g., bottom or rear) surface 214 opposite the first surface. At least one of the first surface 212 or second surface can be substantially planar (e.g., in the absence of a deformation force). Each of the first surface 212 and second surface 214 can be disposed on or overlying a surface of the patient's body. For example, the first surface 212 can be disposed on the patient's head when the template 210 is properly positioned behind an ear of the patient, as described herein, and the second surface 214 can be disposed on the patient's head when the template 210 is properly positioned behind the other ear of the patient, as described herein.

The template 210 has a perimeter 220, which includes or is otherwise formed by side portions 218 (see, e.g., FIGS. 4-5) of the template 210 that extend from the first surface 212 to the second surface 214. The perimeter 220 includes a first end portion 222 and a second end portion 224 opposite the first end portion. The perimeter 220 also includes a first side portion 226 and a second side portion 228, each disposed between the first end portion 222 and the second end portion 224. The second side portion 228 is opposite the first side portion 226.

The second side portion 228 can be any suitable shape and size. In some embodiments, the second side portion 228 can be convex. In some embodiments, the second side portion 228 can include a grip portion configured to be grasped by the fingers or hand of the user when disposing the template 210 with respect to the preselected anatomical structure.

Figure 6:
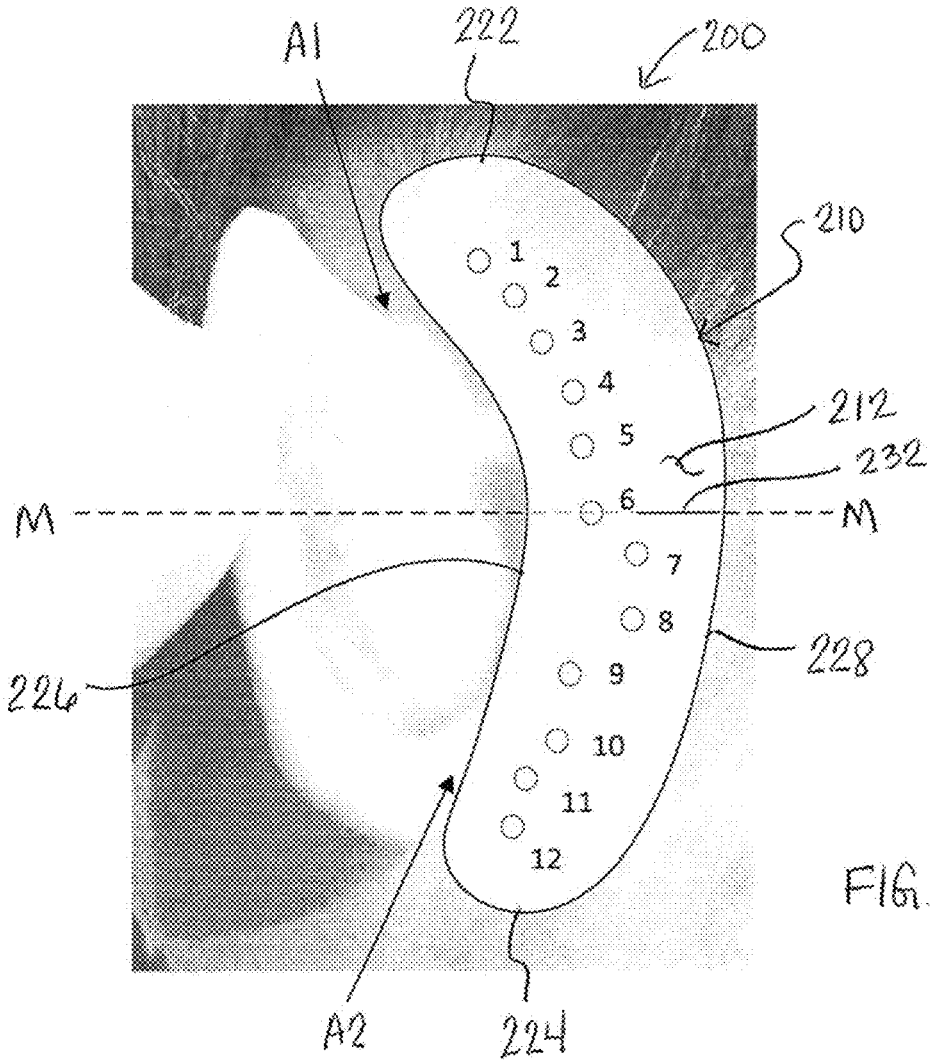
FIG. 6 is a side view of the apparatus of FIG. 2 positioned with respect to a body of a patient.

A portion of the template 210 is sized and shaped to be partially disposed about a curvature of a preselected portion or anatomical structure of a body. In some embodiments, the preselected portion of the body (or preselected anatomical structure) is an ear or a head of a patient. More specifically, in some embodiments, the template 210 is sized and shaped to be partially disposed about a curvature of the body at a location where the ear attaches to the head of the patient (e.g., at an attachment location behind the ear), as shown in FIG. 6. For example, the first side portion 226 of the template's 210 perimeter 220 can be shaped and sized to be disposed at least partially around the preselected anatomical structure (e.g., the curvature of the body behind the ear and at the location where the ear is attached to the head). The first side portion 226 of the perimeter 220 can be concave, curved, or otherwise recessed (e.g., from a top or bottom view of the template), such that the curvature can be received within the concavity (or curve or recess) of the template 210.

Figure 2:
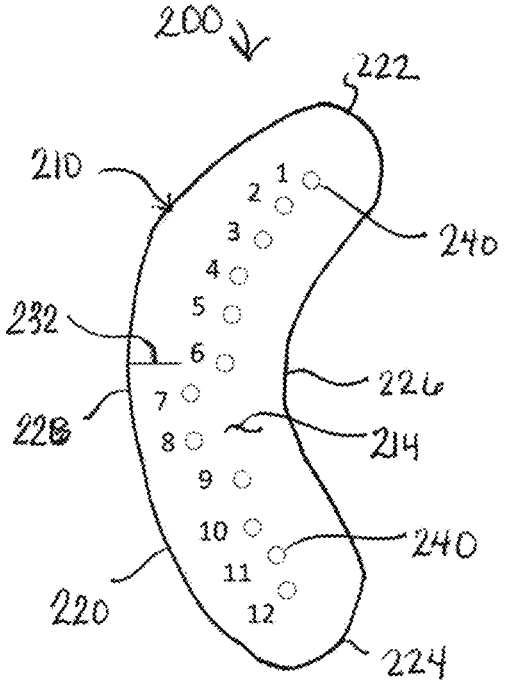
FIG. 2 is a top view of an acupoint locator apparatus, according to another embodiment.
Figure 7:
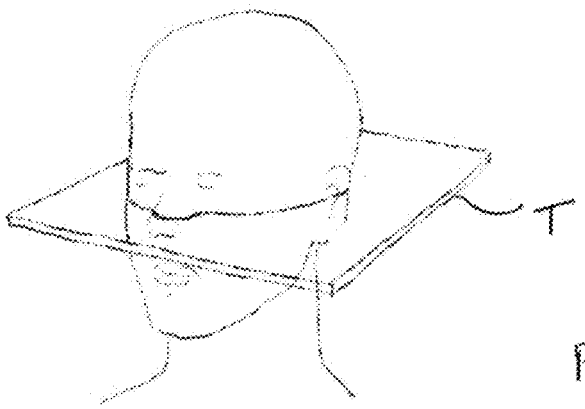
FIG. 7 is a perspective view of a body with a representative transverse plane.

The template 210 includes an indicia 232 for indicating an alignment of the template with respect to the patient's body. As shown in FIG. 2, the indicia 232 is a visual indication that is configured to be aligned with a preselected anatomical location when the template is disposed on the surface of the body relative to the preselected anatomical structure. The indicia can, for example, be configured to be aligned, along a transverse plane of the body, with a midline of an ear, as indicated by broken line M in FIG. 6. An example transverse plan T is shown for illustration purposes in FIG. 7. The indicia 232 of apparatus 200 includes a straight line that, when parallel to the midline M of the ear, indicates the template 210 is properly positioned with respect to the body (and the preselected anatomical structure, or ear, specifically) such that an acupoint locator 240 of the apparatus 200 is overlying a preselected acupoint of the body, as described herein. In other embodiments, the template 210 can include indicia configured to be aligned with a top of an attachment of the ear to a head (indicated by arrow A1 in FIG. 6) or a bottom of the attachment of the ear to the head (indicated by arrow A2 in FIG. 6), in addition to or instead of the indicia 232 to be aligned with the midline M of the ear, or a combination thereof.

The acupoint locator 240 enables a user to properly position the acupressure tool with respect to the preselected acupoint. The apparatus 200 includes multiple acupoint locators 240 that are apertures, or openings, that extend from the first surface 212 of the template 210 to the second surface 214 of the template 210. The apertures 240 are each sized and shaped to be disposed overlying a respective unique preselected acupoint of the body (e.g., when the portion of the template 210 is partially disposed about the curvature of the body). More particularly, the apertures 240 are arranged with respect to the template 210 in a pattern that results in the apertures 240 being disposed overlying the respective preselected acupoints when the template 210 is properly positioned with respect to the preselected anatomical structure. The apparatus 200 is shown as including twelve apertures 240, which are arranged with respect to the template 210 such that the apertures 240 can be disposed overlying twelve unique preselected acupoints of the head when the template 210 is properly positioned on the head and behind the patient's ear. One or more of the unique preselected acupoints can be associated with weight loss. More specifically, each of the twelve unique preselected acupoints can be associated with weight loss, with at least one (or, in some instances only one) of the twelve acupoints being active at a time. In some embodiments, for example as shown in FIGS. 2-3, the apertures 240 are numbered 1 through 12, on at least one of the first surface 112 or the second surface of the template 210, for ease of reference or aperture identification by a user.

Figure 3:
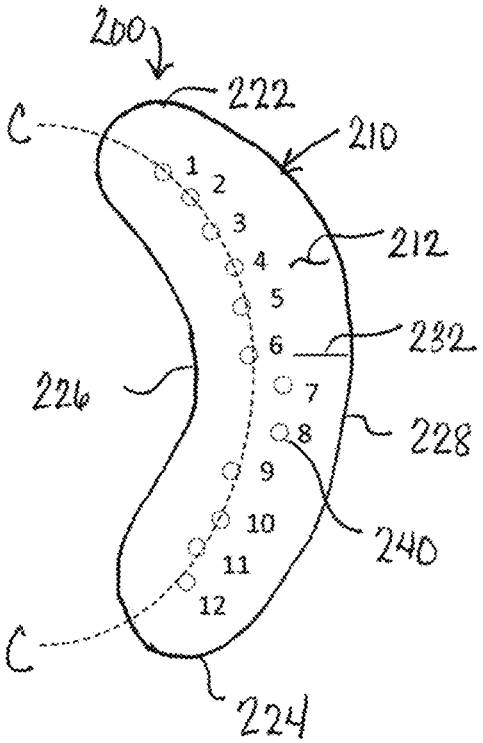
FIG. 3 is a bottom view of the apparatus of FIG. 2.
Figure 4:
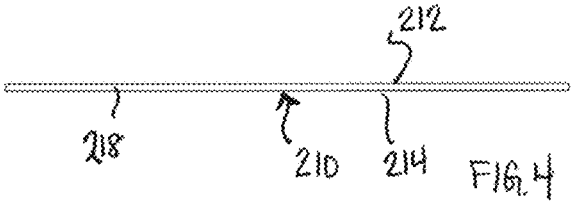
FIG. 4 is a side view of the apparatus of FIG. 2. The opposing side view (not shown) of the apparatus of FIG. 2 can be substantially identical to the side view shown in FIG. 4.
Figure 5:
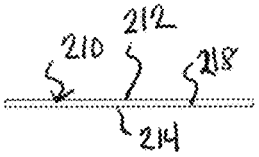
FIG. 5 is an end view of the apparatus of FIG. 2. The opposing end view (not shown) of the apparatus of FIG. 2 can be substantially identical to the end view shown in FIG. 5.

Referring to FIG. 3, the apertures 240 are arranged on the template 210 such that a first subset of apertures 240 (e.g., ten apertures, such as those apertures numbered 1-6 and 9-12 in FIG. 3) are arranged in a substantially curvilinear pattern (e.g., at least one location of each aperture 240 intersects with a respective point or location along a curved line C, which can be an arc, semicircle, or substantially C-shaped or U-shaped line), and a second subset of apertures 240 (e.g., two apertures, such those apertures numbered 7 and 8 in FIG. 3) are arranged offset from the substantially curvilinear pattern (e.g., such that no location of the aperture 240, or no portion of the opening of the aperture or the template defining the opening of the aperture, intersects with the curved line). Although the template 210 is illustrated in FIG. 3 as including the second subset of apertures arranged offset from the curved line C, in other embodiments, each aperture can be positioned with respect to the template such that the aperture is intersected by a curved or C-shaped line. In still other embodiments, the second subset of apertures arranged offset from the substantially curvilinear pattern can include more than two apertures, or one or more apertures in addition to or different from apertures numbered 7 and 8 in FIG. 3. Each aperture 240 is spaced apart from the first side portion 226 by a predetermined distance. The predetermined distance for a respective aperture 240 can be different from the predetermined distance for another aperture 240. For example, in the apparatus 200 of FIG. 3, two apertures (apertures #7 and #8) 240 are each spaced by a respective predetermined distance from the first side portion 226 that is greater than the predetermined distance by which the remaining apertures 240 (apertures #1-6 and #9-12) are spaced from the first side portion 226. Two or more apertures 240 can be spaced apart from the first side portion 226 by substantially the same predetermined distance. The apertures 240 are arranged with respect to the template 210, and more particularly with respect to the first side portion 226 of the perimeter 220 of the template 210 such that, when the template 210 is positioned behind the patient's ear such that the curvature of the ear (or attachment of the ear to the head) is at least partially received by the first side portion 226 of the perimeter 220 and such that one of the first surface 212 or second surface of the template 210 is disposed on or facing the patient's head (depending on the side of the patient's head to which acupressure is to be applied) the apertures 240 are positioned overlying a respective unique preselected acupoints of the head that are each associated with weight loss.

The aperture 240 can be any suitable size that permits an acupressure bead or marking instrument to be at least partially passed therethrough or disposed therein, without permanent deformation of the template 210 at a perimeter of that respective aperture. For example, the aperture can have a diameter within a range of about 0.5 mm to about 10 mm. The aperture 240 can have a diameter within a range of about 1 mm to about 4 mm. More specifically, the aperture 240 can have a diameter of about 2 mm. Although the apertures 240 are shown as being substantially circular, in other embodiments, an aperture can have any suitable perimeter shape (e.g., an oval, square, star, or other suitable shape).

Although the template 210 is shown as defining twelve apertures 240, in other embodiments, the template 210 can include any suitable number of apertures. For example, the template 210 can include one, two, three, four, five, six, seven, eight, nine, ten, eleven, or more apertures 240.

In some embodiments, a kit according to an embodiment includes at least two templates. Each template can be substantially similar to template 210 (or any other template described herein), except that the templates can differ in the number of apertures 240 (or other apertures or acupoint locators described herein) defined by the template. For example, the kit can be configured to locate a set of preselected acupoints, such as the twelve preselected acupoints associated with weight loss that are described above, however the respective acupoint locators can be divided or otherwise distributed amongst the templates of the kit. In other words, the templates of the kit can collectively include acupoint locators that correspond to the acupoint locators 240 of the template 210 described above. In this manner, each template of the kit is simplified in that it can include less acupoint locators than the template 210. By reducing the quantity of acupoint locators per template, the potential for confusion by a user (e.g., a user that is also the patient) during use between neighboring acupoint locators can be reduced, for example, due to having a fewer number of acupoint locators included on a respective template and/or due to greater spacing between acupoint locators than that shown with respect to template 210.

The kit can include, for example, a first template and a second template, each of which can be configured to locate a respective first and second set of acupoints in reference to a preselected anatomical structure when the respective template is disposed relative to the preselected anatomical structure. The second set of acupoints can be different from the first set of acupoints. For example, a patient's head includes twelve acupoints located behind the patient's ear that are each associated with weight loss. In one example, the first set of acupoints can include up to eleven of the acupoints, and the second set can include the remaining acupoints not included in the first set or a subset thereof. In another example, at least one of the first or second sets of acupoints includes at least one acupoint not included in the other of the first or second sets of acupoints. Said another way, in some embodiments, the first and second sets of acupoints can each include at least one acupoint in common, however, at least one of the first and second sets of acupoints includes at least one acupoint different from the other of the first or second sets of acupoints.

The first template defines a first set of acupoint locators (e.g., apertures) and the second template defines a second set of acupoint locators (e.g., apertures). The second set of acupoint locators includes at least one acupoint locator positioned with respect to the second template differently from each acupoint locator of the first set of acupoint locators of the first template. Said another way, in some embodiments, the second set of acupoint locators can include at least one acupoint in common with the first set of acupoint locators, however, at least one of the first set or second set of acupoint locators includes at least one acupoint locator different from the acupoint locators of the other of the first or second sets of acupoint locators.

As an example, the first template can include a first set of apertures 240 that includes six apertures (e.g., the even numbered apertures shown in FIG. 2) and the second template can include a second set of apertures that includes a different six apertures (e.g., the odd numbered apertures shown in FIG. 2). In another example, the first template can include a first set of apertures 240 that includes six apertures (e.g., the even numbered apertures shown in FIG. 2) and the second template can include a second set of apertures that includes a different seven apertures (e.g., the odd numbered apertures and an even numbered aperture, such as aperture at position number 6, shown in FIG. 2).

Figure 8:
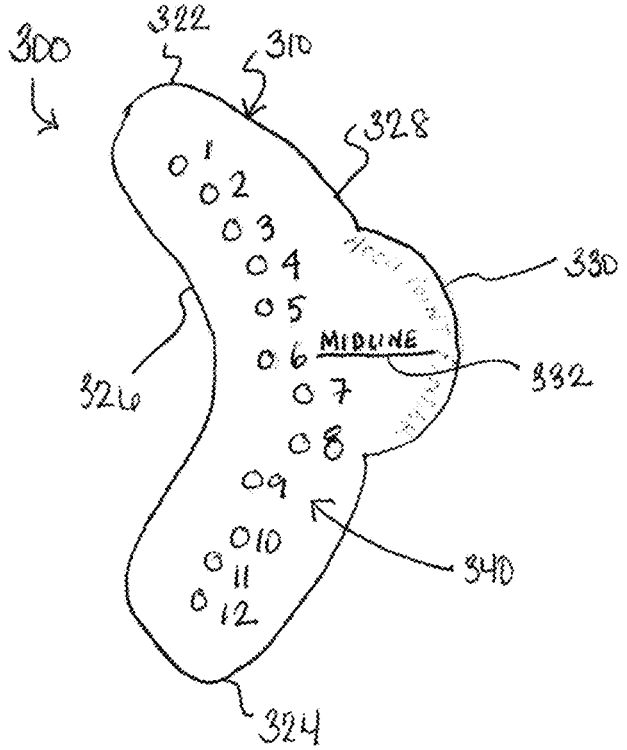
FIG. 8 is a top view of an acupoint locator apparatus according to another embodiment. A bottom view (not shown) of the apparatus of FIG. 8 can be a mirror-image of the top view shown in FIG. 8.

An apparatus 300 according to another embodiment is shown in FIG. 8. The apparatus 300 can be similar, or identical, in many respects to any apparatus (e.g., apparatus 100, 200) described herein, and so similar features are not described in detail. The apparatus 300 is configured for repeatable and accurate positioning of an acupressure tool with respect to a preselected acupoint of a patient's body. The apparatus 300 includes a template 310 and a set of acupoint locators 340 (e.g., apertures). The template 310 is sized and shaped to facilitate its being grasped by a user. For example, as shown in FIG. 8, the template 310 includes a grip portion 330. More specifically, the template 310 can include a first end portion 322 and an opposing second end portion 324, and a first side portion 326 and opposing second side portion 328 each extended between the first and second end portions 322, 324. The grip portion 330 can be extended from the second side portion 328 of the template 310. The grip portion 330 can be, for example, a tab extended from the second side portion 328. In another example, the grip portion 330 can be a convex extension of the second side portion 328 of the template 310. The grip portion 330 can be substantially centrally located between the first end portion 322 and the second end portion 324 of the template 310.

The grip portion 330 is sized and shape such that the user can grip the template 310 by and between, for example, a thumb and index (or other) finger of the user. In some embodiments, the grip portion 330 can have a textured surface (e.g., raised ridges, recessed grooves, dimples, a roughened surface, or the like) that increases the friction between the grip portion and the user's hand, thereby better resisting slippage of the template 310 (compared to template having a smooth surface) from the user's grasp during use. As shown in FIG. 8, the grip portion 330 is extended from a convex second side portion 328 of the template 310 opposite the concave first side portion 326 of the template 310 that is configured to at least partially receive a curvature of a preselected anatomical structure. The template 310 includes a midline (or other) indicia 332, which can be at least partially disposed on the grip portion 330.

Figure 9:
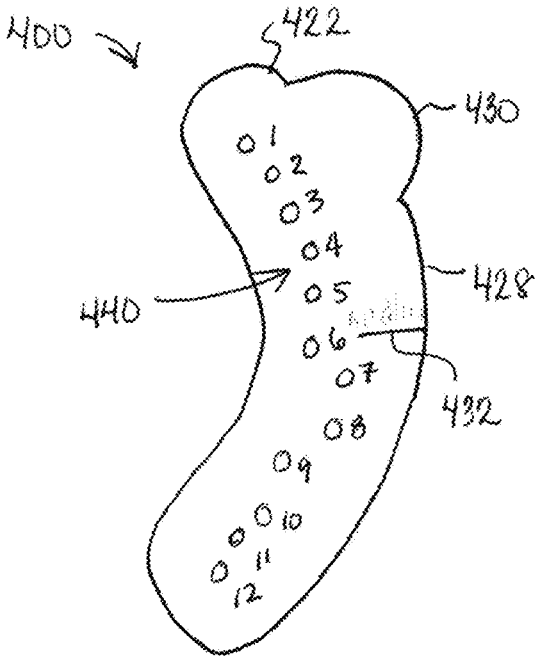
FIG. 9 is a top view of an acupoint locator apparatus according to yet another embodiment. A bottom view (not shown) of the apparatus of FIG. 9 can be a mirror-image of the top view shown in FIG. 9.

Although the grip portion 330 is shown in FIG. 8 as being substantially centered with respect to the length of the template 310 between its first and second end portions 322, 324, respectively (or with respect to indicia 332), in other embodiments, a template can include a differently positioned grip portion. For example, as shown in FIG. 9, in some embodiments, an apparatus 400 configured for positioning an acupressure tool with respect to a body includes a template 410 and a set of acupoint locators 440. Features of the apparatus 400 can be substantially similar or identical to, or include features substantially similar or identical to, other apparatus (e.g., apparatus 100, 200, 300) described herein, and so are not described in detail herein. The template 410 includes a grip portion 430 that is extended from a second side portion 428 of the template 410 (or of a perimeter of the template) between a midline of the template (or an indicia 432 of the template) and a first end portion 422 of the template.

Figure 10:
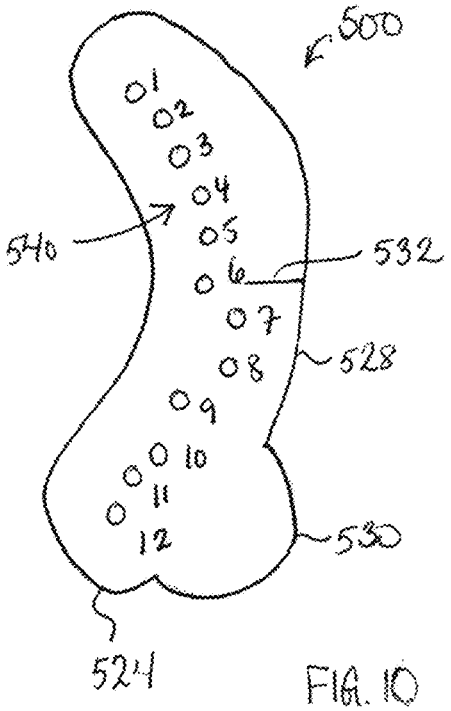
FIG. 10 is a top view of an acupoint locator apparatus according to yet another embodiment. A bottom view (not shown) of the apparatus of FIG. 10 can be a mirror-image of the top view shown in FIG. 10.

In another example, as shown in FIG. 10, in some embodiments, an apparatus 500 configured for positioning an acupressure tool with respect to a body includes a template 510 and a set of acupoint locators 540. Features of the apparatus 500 can be substantially similar or identical to, or include features substantially similar or identical to, other apparatus (e.g., apparatus 100, 200, 300, 400) described herein, and so are not described in detail herein. The template 510 includes a grip portion 530 that is extended from a second side portion 528 of the template 510 (or of a perimeter of the template) between a midline of the template (or an indicia 532 of the template) and a second end portion 524 of the template.

Figure 11:
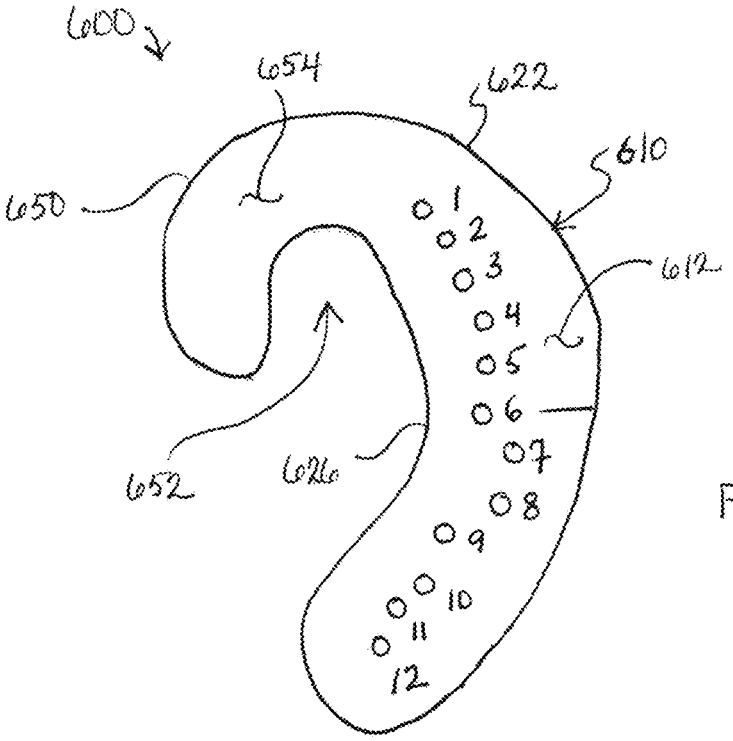
FIG. 11 is a top view of an acupoint locator apparatus according to yet another embodiment. A bottom view (not shown) of the apparatus of FIG. 11 can be a mirror-image of the top view shown in FIG. 11.

An apparatus 600 according to another embodiment is shown in FIG. 11. The apparatus 600 is configured for positioning an acupressure tool with respect to a body. Features of the apparatus 600 can be substantially similar or identical to, or include features substantially similar or identical to, other apparatus (e.g., apparatus 100, 200, 300, 400, 500) described herein, and so are not described in detail herein. The apparatus 600 includes a template 610 and a set of acupoint locators 640. The apparatus 600 is configured to retain itself to the body of the patient. As shown in FIG. 11, the template 610 includes a preformed hook portion 650. The preformed hook portion 650 and at least one of a first end portion or a first side portion 626 of the template 610 collectively define a channel 652. The channel 652 is sized to receive at least a portion of the anatomical structure when the at least the portion of the preselected anatomical structure is received in the concave first side portion of the perimeter of the template. In this manner, the template 610 is retained to the anatomical structure. In use, for example, the preformed hook portion 650 can be disposed over an ear of the patient such that an upper portion of a patient's body at the attachment of the patient's ear to the patient's head is at least partially received in the channel 652. The template 610 can hang from the patient's ear by the preformed hook portion 650, thereby being retained to the patient's body. A first surface 654 of the hook portion can be co-planar with a first surface 612 of the template 610 extended between the first side portion 626 and a second side portion 628 of the template. Similarly, a second surface (not shown) of the preformed hook portion 650 can be co-planar with a second surface (not shown) of the template 610 extended between the first side portion 626 and a second side portion 628 of the template. In some embodiments, the hook portion 650 is monolithically formed with the template 610. In other embodiments, the hook portion is coupled to (e.g., removably coupled to) the template.

Figure 12:
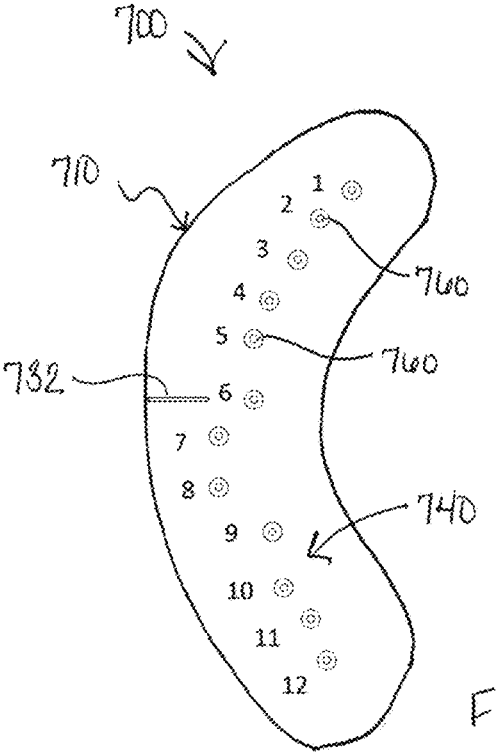
FIG. 12 is a top view of an acupoint locator apparatus according to yet another embodiment. A bottom view (not shown) of the apparatus of FIG. 12 can be a mirror-image of the top view shown in FIG. 12.

An apparatus 700 according to another embodiment is illustrated in FIG. 12. The apparatus 700 is configured for positioning an acupressure tool with respect to a body.

Features of the apparatus 700 can be substantially similar or identical to, or include features substantially similar or identical to, other apparatus (e.g., apparatus 100, 200, 300, 400, 500, 600) described herein, and so are not described in detail herein. The apparatus 700 includes a template 710 and a set of acupoint locators 740. The apparatus 700 includes a tactile and visual indicia 732 coupled to the template 710. The indicia 732 can be, for example, a raised elongate ridge, as shown in FIG. 12. The indicia 732 has a longitudinal axis along its length (not shown) that is configured to intersect with a predetermined acupoint locator 740 (such as an aperture and/or acupressure bead at position number 6 on the template 710). In use, the indicia 732 is aligned such that its longitudinal axis is parallel to one of a midline of a preselected anatomical structure (e.g., the ear) or such that its longitudinal axis is disposed on a transverse plane of the body taken at a preselected anatomical location (e.g., an upper attachment of the ear to the head, a midline of the ear, a lower attachment of the ear to the head, or another preselected anatomical location). When the indicia 732 is aligned as such, one or more of the acupoint locators 740 and at least one acupressure bead 760 are disposed overlying unique preselected acupoints (e.g., one or more of the twelve acupoints on the head and behind the patient's ear, as shown in FIG. 6). Although the apparatus 700 is shown and described as including an acupressure bead 760 disposed with respect to each acupoint locator 740, in some embodiments, an apparatus can include an acupressure bead disposed with respect to less than all (e.g., one, two, three, four, . . . eleven) of the acupoint locators 740.

The apparatus 700 includes an acupressure tool 760 (e.g., an acupressure bead). The acupressure tool 760 can be removably coupled to the template 710. For example, the acupressure tool 760 can be disposed one the acupoint locator 740. In another example, the acupoint locator 740 can include an aperture as described herein, and the tool 760 can be disposed within the aperture. The tool 760 can be retained to the template 710 (e.g., on the acupoint locator 740 or within the aperture) by any suitable coupling mechanism, including, for example, breakable tabs (not shown), a bandage that is removably coupled to the template 710, a temporary or removable adhesive, or the like, or any combination thereof. The tool 760 can include an adhesive configured to retain the tool to the patient's body, for example, such that the tool is retained to the patient's body after the tool is uncoupled from the template.

Figure 13:
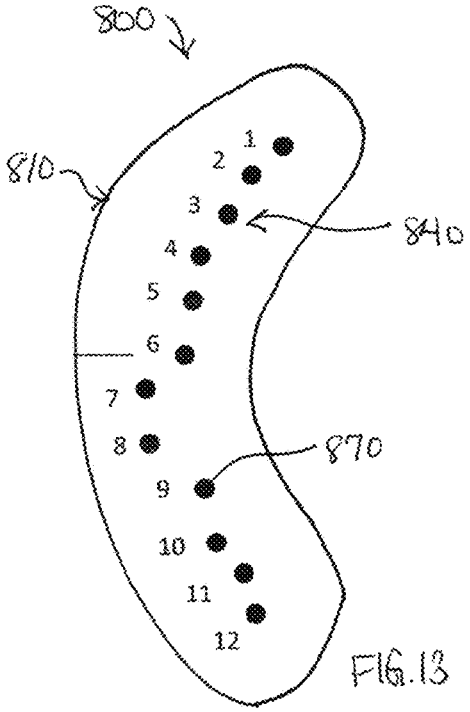
FIG. 13 is a top view of an acupoint locator apparatus according to another embodiment. The bottom view (not shown) of the apparatus of FIG. 13 can be a mirror-image of the top view shown in FIG. 13.

An apparatus 800 according to another embodiment is illustrated in FIG. 13. The apparatus 800 is configured for positioning an acupressure tool with respect to a body. Features of the apparatus 800 can be substantially similar or identical to, or include features substantially similar or identical to, other apparatus (e.g., apparatus 100, 200, 300, 400, 500, 600, 700) described herein, and so are not described in detail herein. The apparatus 800 includes a template 810 and a set of acupoint locators 840. The apparatus 800 also includes a marker 870 disposed on the template 810 at one or more acupoint locators 840. The marker is at least partially transferable to a skin of the body. For example, the marker 870 can include a transferable ink, dye, colored gel, or the like. In another example, the marker 870 can be a pre-inked well configured to have pressure applied to a backside thereof by a user when the template 810 is properly positioned with respect to the body such that the acupoint locator 840 is disposed overlying a preselected acupoint of the body, such that the well releases at least a portion of the ink to the skin of the patient overlying the preselected acupoint. In this manner, the user can use the apparatus 800 to locate and mark the location of the preselected acupoint, and after transferring the marker to the skin overlying the preselected acupoint, remove the apparatus 800 from the body before applying an acupressure tool to the marked preselected acupoint. This can be beneficial, for example, in circumstances where the user desires to apply acupressure using a tool that cannot readily be at least partially disposed through an aperture like that of apparatus 200.

Figure 14:
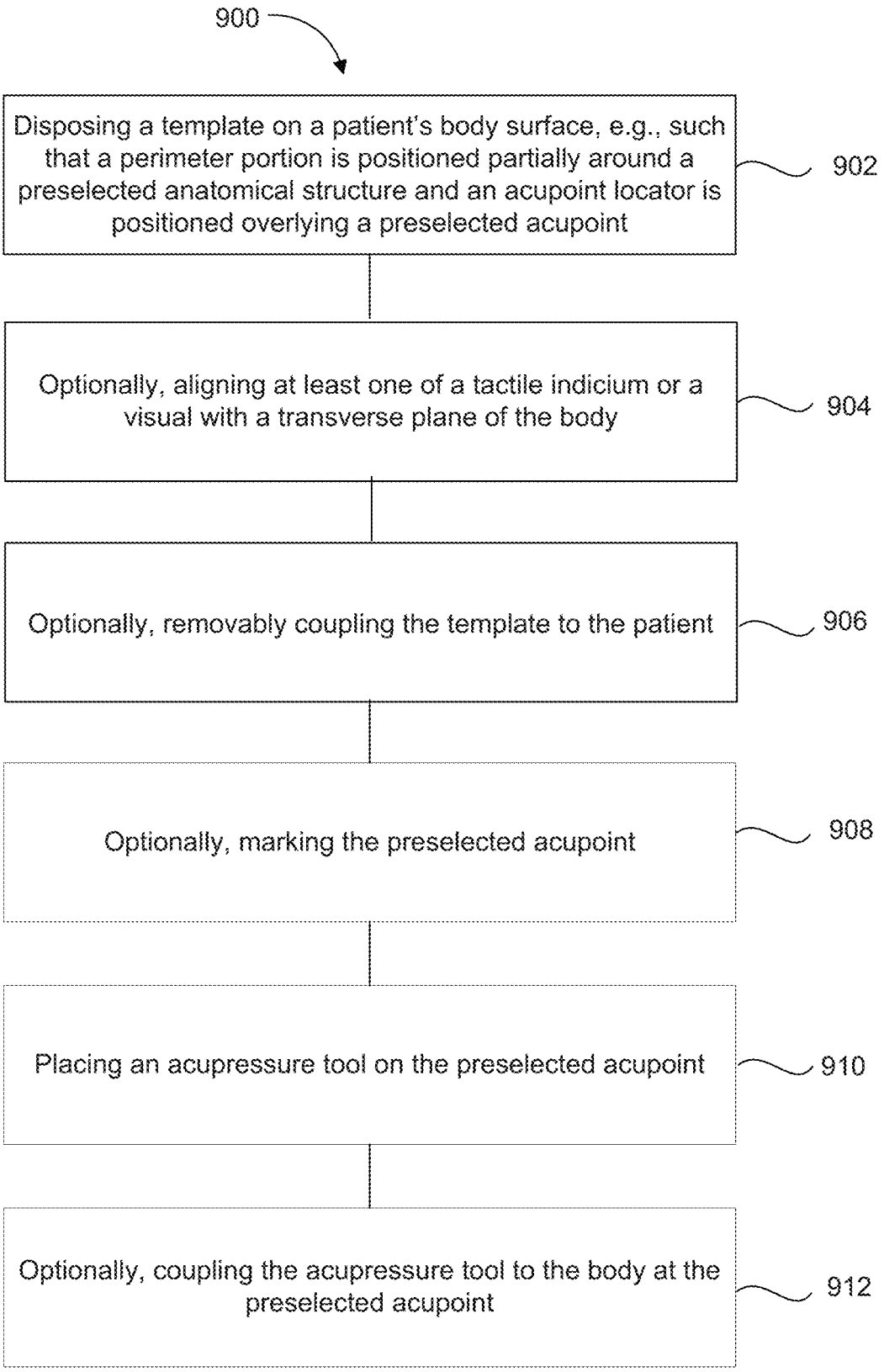
FIG. 14 is a method for positioning an acupressure tool with respect to a body, according to an embodiment.

In use, an apparatus described herein (e.g., apparatus 100, 200, 300, 400, 500, 600, 700, 800) can be used according to embodiments for positioning an acupressure tool with respect to a body of a patient, and more particularly for positioning the tool overlying a preselected acupoint of the patient. A method 900 according to an embodiment is illustrated in FIG. 14. In some embodiments, the method 900 includes, at step 902, disposing a template (e.g., template 200 or any template described herein) on a surface of the body relative to a preselected anatomical structure of the body. The preselected anatomical structure can be, for example, an ear of the patient. The template can be disposed on a surface of the patient's head relative to a rear side of the patient's ear. The template can be disposed such that a first portion of a perimeter of the template is positioned at least partially around at least a portion of the preselected anatomical structure and such that an acupoint locator of the template is positioned overlying a preselected acupoint of the body. For example, the template can be disposed such that at least a portion of a perimeter of the template is positioned at least partially around an attachment location of the patient's ear to the patient's head (e.g., behind the patient's ear) and such that the acupoint locator is positioned overlying a preselected acupoint of the patient's head. More specifically, a curvature of the rear side of the patient's ear can be at least partially received in a concave portion of the template when the template is disposed with respect to the surface of the body and a substantially planar surface of the template can be disposed overlying the head such that the acupoint locator is positioned overlying one of a set (e.g., twelve) of preselected acupoints of the patient's head that are associated with weight loss. The acupoint locator can be, for example, an aperture, which can permit a user to apply an acupressure tool to the patient's body therethrough, as described herein.

The method 900 optionally includes, at step 904, aligning, when the first portion of the perimeter of the template is positioned at least partially around the at least the portion of the preselected anatomical structure, at least one of a tactile indicium or a visual indicium of the template with a transverse plane of the body taken at a preselected anatomical location, such a one of a midline of the preselected anatomical structure or a preselected attachment location of the preselected anatomical structure to another portion of the body. In some embodiments, the acupoint locator is intersected by the transverse plane when the template is properly disposed with respect to the surface of the body, as described herein, such that the acupoint locator overlies the preselected acupoint. Alignment of such an indicia of the template with the body can help to ensure accurate placement of the acupoint locator over the unique preselected acupoint.

The method 900 optionally includes, at step 906, removably coupling the template to the patient. For example, in some uses, a channel defined by the template is disposed over an upper outer surface of an ear of the patient. In some embodiments, for example, the template includes a preformed hook portion (as described with respect to apparatus 600 in reference to FIG. 11), and the hook portion can be placed over an upper outer surface of the ear of the patient such that a portion of the ear is received in a channel defined by the hook portion and/or the template. In other embodiments, a clasp of the apparatus is clasped or otherwise coupled to a portion of the patient's body. In still other embodiments, the apparatus includes an adhesive (e.g., a temporary or removably adhesive) configured to couple the template to the body. For example, the template can include an adhesive on at least one of a first or second surface thereof, and the adhesive can be used to couple the template to the patient's skin when the template is disposed thereon.

The method 900 optionally includes, at step 908, marking the preselected acupoint, e.g., by the user and after the acupoint locator is disposed overlying the preselected acupoint. For example, the preselected acupoint can be marked via a transferable marker disposed on the template at the acupoint locator, such as described herein with respect to apparatus 800 in reference to FIG. 13. In another example, the preselected acupoint can be marked via a marking instrument (e.g., a surgical pen or the like, as described herein) disposed through an aperture defined by the template at the acupoint locator.

The method 900 includes at step 910 placing, after the template is disposed on the surface of the body, as described above, an acupressure tool on the preselected acupoint. The acupressure tool is at least one of separate from or separable from the template. For example, the acupressure tool can be an acupressure bead that is separate from the template, or an acupressure bead that is removably coupled to the template (e.g., as described above with respect to apparatus 700 in reference to FIG. 12). In some embodiments, the method 900 optionally includes at step 912, coupling the acupressure tool to the body at the preselected acupoint. For example, in some embodiments, in which the acupoint locator includes an aperture and the acupressure tool is an acupressure bead, the acupressure bead can be coupled to the body at the preselected acupoint. For example, the acupressure bead can be passed through the aperture before the bead is coupled to the body. In another example, the acupressure bead can be at least partially disposed within the aperture before the bead is coupled to the body. In some embodiments, the acupressure tool (e.g., an acupressure bead) is removably coupled to the template. In use, such an acupressure tool can be placed on the preselected acupoint and removed or otherwise separated from the template and coupled to the body. In some embodiments, the acupressure tool (e.g., the acupressure bead) is coupled to the body by a bandage, an adhesive, or the like. The user can then use the acupressure tool to apply acupressure to the preselected acupoint. In some embodiments, the acupressure tool is coupled to the template, and remains coupled to the template while acupressure is performed. For example, the template and the acupressure tool (e.g., an acupressure bead) coupled thereto, or disposed on, the patient's body, as described herein, and acupressure can be applied to the preselected acupoint via the acupressure tool coupled to the template (and optionally coupled to the patient).

In use, the template can be used to locate a second preselected acupoint. For example, an active first preselected acupoint will become inactive after a period of time, such as about seven to nine days, at which time a second preselected acupoint will become active. The template can be used to locate the first preselected acupoint at a first time, and them used to locate the second preselected acupoint at a second time, e.g., subsequent the first time. In some embodiments, a user can use a first template (e.g., from a kit of templates) to locate the first preselected acupoint, as described herein, and a second template (e.g., from the kit of templates) to locate the second preselected acupoint, as described herein.

The apparatus described herein are configured to help locate acupoints as described herein with respect to patients of different sizes. Stated differently, the apparatus described herein with templates having a given size and shape, and arrangement of acupoint locators, can be used for patients of different sizes, and more particularly with different head or ear sizes. More particularly, the first side portion (e.g., first side portion 226) of the template (e.g., template 210) has a radius of curvature that permits the template to be disposed around a portion of the curvature of the ear, as described herein, for patients with different sized ears. In use, and when the template is disposed with respect to the ear as described herein, a greater portion of the first side portion may be in contact with the patient's ear curvature for patients with larger sized ears, than is in contact with the patient's ear curvature for patients with smaller sized ears. As such, the template can be properly aligned (e.g., with a midline of the ear or other preselected anatomical structure) for patients with differing head or ear sizes such that the acupoint locators of the template are disposed overlying the preselected acupoints as described herein.

While various embodiments have been described above, it should be understood that they have been presented by way of example only, and not limitation. Where schematics and/or embodiments described above indicate certain components arranged in certain orientations or positions, the arrangement of components may be modified. While the embodiments have been particularly shown and described, it will be understood that various changes in form and details may be made. Although various embodiments have been described as having particular features and/or combinations of components, other embodiments are possible having any combination or sub-combination of any features and/or components from any of the embodiments described herein.

For example, although the template is shown and described herein as being sized and shaped to be disposed overlying a preselected acupoint behind the ear of a patient, in other embodiments, the template can be sized and shaped to be disposed overlying a preselected acupoint at a different location of the patient's anatomy.

For example, although the template is shown and described herein as including a specified number of apertures (e.g., twelve apertures), in other embodiments, the template can include any suitable number of openings, including, but not limited to, one, two, three, four, five, six, seven, eight, nine, ten, eleven, or more openings.

The specific configurations of the various components described herein can also be varied. For example, the size and specific shape of the various components can be different from the embodiments shown, while still providing the functions as described herein. Additionally, the relative size of various components of the devices shown and described herein with respect to the size of other components of the devices are not necessarily to scale.

For example, although the template (e.g., template 200) is shown and described herein as being concave on a first side portion and convex on a second side portion, in other embodiments, however, one or more sides of a template can have any suitable shape. For example, in some embodiments, a first side portion of a template includes convex and concave curvatures, which can be sized and shaped to complement a preselected curvature of a patient's body.

Similarly, where methods and/or events described above indicate certain events and/or procedures occurring in certain order, the ordering of certain events and/or procedures may be modified. While the embodiments have been particularly shown and described, it will be understood that various changes in form and details may be made.

What is claimed is:

1. An apparatus, comprising:

a template having a surface and a perimeter around the surface, a portion of the perimeter of the template defining a recess sized and shaped to at least partially receive a curvature of a preselected portion of a body, the template defining a plurality of apertures, each aperture from the plurality of apertures configured to be disposed overlying a unique preselected acupoint of the body from a plurality of preselected acupoints of the body when the portion of the template is partially disposed about the curvature; and an acupressure bead being coupled to the template so that the acupressure bead is at least partially disposed within the at least one aperture from the plurality of apertures, the acupressure bead configured to be coupled to the body overlying the unique preselected acupoint when the portion of the template is partially disposed about the curvature, the acupressure bead being separable from the template.

2. The apparatus of claim 1, wherein the plurality of apertures includes a first aperture that is configured to be located on a transverse plane of the body taken at a midline of an ear when the portion of the template is partially disposed about the curvature.

3. The apparatus of claim 1, wherein:

each aperture of the plurality of apertures is configured to be disposed overlying a unique preselected acupoint of the body from the plurality of preselected acupoints that are associated with weight loss.

4. The apparatus of claim 1, wherein:

the portion of the perimeter of the template is a first portion, at least a subset of the plurality of apertures forms a curvilinear pattern, and the curvilinear pattern of the at least the subset of the plurality of apertures is closer to the first portion of the perimeter of the template defining the recess than to a second portion of the perimeter of the template that is opposite the surface of the template from the first portion of the perimeter of the template.

5. The apparatus of claim 1, wherein the plurality of apertures includes a first aperture having a diameter within a range of about 0.5 mm to about 10 mm.

6. The apparatus of claim 1, wherein each aperture from the plurality of apertures is sized to permit the acupressure bead to be passed therethrough without permanent deformation of the template at a perimeter of that aperture.

7. The apparatus of claim 1, wherein the template includes a marker that is at least partially transferable to a skin of the body.

8. The apparatus of claim 1, wherein the surface includes an indicia configured to be aligned, along a transverse plane of the body, with one of a midline of an ear, a top of an attachment of the ear to a head, or a bottom of the attachment of the ear to the head.

9. A method, comprising:

disposing a template behind an ear of a body and overlying a head of the such that a portion of a perimeter of the template is positioned at least partially around at least a portion of at least one of the ear or an attachment location of the ear to the head and such that an acupoint locator of the template is positioned overlying a preselected acupoint of the head, the acupoint locator including an aperture defined by the template;

placing, after the disposing, an acupressure tool on the preselected acupoint, the acupressure tool including an acupressure bead, the acupressure tool being at least one of separate from or separable from the template; and coupling the acupressure bead to the body at the preselected acupoint, the acupressure bead being at least one of passed through the aperture before the coupling or at least partially disposed within the aperture before the coupling.

10. The method of claim 9, further comprising:

marking the preselected acupoint via a transferable marker disposed on the template at the acupoint locator.

11. The method of claim 9, further comprising:

aligning, when the portion of the perimeter of the template is positioned at least partially around the at least the portion of the ear or the attachment location of the ear to the head, at least one of a tactile indicium or a visual indicium of the template with a transverse plane of the body taken at one of a midline of the ear or the attachment location of the ear to the head, the acupoint locator being intersected by the transverse plane.

12. The method of claim 9, further comprising:

disposing a channel defined by the template over an upper outer surface of one of the ear or the attachment location of the ear to the head.

13. The method of claim 9, further comprising:

coupling the acupressure bead to the template so that the acupressure bead is at least partially disposed within the aperture.

14. An apparatus, comprising:

a template configured to locate a first plurality of acupoints in reference to a first preselected anatomical structure when the template is disposed relative to the first preselected anatomical structure, the template configured to locate a second plurality of acupoints in reference to a second preselected anatomical structure when the template is disposed relative to the second preselected anatomical structure, the template having a first surface, a second surface opposite the first surface, and a perimeter, the perimeter including a first end portion, a second end portion opposite the first end portion, a first side portion extended between the first end portion and the second end portion, and a second side portion extended between the first end portion and the second end portion, the second side portion opposite the first side portion, the first side portion being concave, the second side portion being convex, the template defining a plurality of acupoint locators, the plurality of acupoint locators including a plurality of apertures, the plurality of acupoint locators configured to be positioned overlying the first plurality of acupoints when at least a portion of the first preselected anatomical structure is received in the concave first side portion of the perimeter of the template and the first surface of the template faces a body, the plurality of acupoint locators configured to be positioned overlying the second plurality of acupoints when at least a portion of the second preselected anatomical structure is received in the concave first side portion of the perimeter of the template and the second surface of the template faces the body; and an acupressure bead at least partially disposed within a first aperture from the plurality of apertures, the acupressure bead removably coupled to the template, the acupressure bead configured to be coupled to the body.

15. The apparatus of claim 14, wherein the plurality of acupoint locators includes a first subset of acupoint locators arranged in a curvilinear pattern that is concave with respect to the first side portion and a second subset of acupoint locators arranged offset from the curvilinear pattern.

16. The apparatus of claim 14, wherein the template includes a preformed hook portion, the preformed hook portion and the first end portion collectively defining a channel that receives at least a portion of one of the first preselected anatomical structure or the second preselected anatomical structure when the at least the portion of the one or the first preselected anatomical structure of the second preselected anatomical structure is received in the concave first side portion of the perimeter of the template such that the template is retained to the one of the first preselected anatomical structure of the second preselected anatomical structure.

17. The apparatus of claim 14, wherein the template includes a preformed hook portion, the preformed hook portion and the first end portion collectively defining a channel that receives at least a portion of one of the first preselected anatomical structure or the second preselected anatomical structure when the at least the portion of the one of the first preselected anatomical structure or the second preselected anatomical structure is received in the concave first side portion of the perimeter of the template, a first surface of the hook portion being co-planar with the first surface of the template extended between the first side portion and the second side portion.

18. The apparatus of claim 14, wherein the second side portion of the template includes a grip portion extended therefrom, the grip portion sized and configured be grasped by a user when the portion of the one of the first preselected anatomical structure or the second preselected anatomical structure is received in the concave first side portion of the perimeter of the template and the plurality of locators is positioned overlying one of the first plurality of acupoints or the second plurality of acupoints, respectively.

19. The apparatus of claim 14, wherein the template is a first template and the plurality of acupoint locators is a first plurality of acupoint locators, the apparatus further comprising:

a second template configured to locate a third plurality of acupoints in reference to the first preselected anatomical structure when the template is disposed relative to the first preselected anatomical structure, the third plurality of acupoints being different from the first plurality of acupoints, the second template having a perimeter, the perimeter including a first end portion, a second end portion opposite the first end portion, a first side portion extended between the first end portion and the second end portion, and a second side portion extended between the first end portion and the second end portion, the second side portion opposite the first side portion, the first side portion of the second template being concave, the second side portion of the second template being convex, the second template defining a second plurality of acupoint locators, the second plurality of acupoint locators including at least one acupoint locator positioned with respect to template differently from each acupoint locator of the first plurality of acupoint locators, the second plurality of acupoint locators configured to be positioned overlying the third plurality of acupoints when the at least the portion of the first preselected anatomical structure is received in the concave first side portion of the perimeter of the second template.

* * * * *